US005189812A

United States Patent [19]

Ediger

[11] Patent Number: 5,189,812

[45] Date of Patent: Mar. 2, 1993

[54] MOISTURE SENSOR FOR A CONTINUOUS FLOW DRYER

[75] Inventor: Randall J. Ediger, Hampton, Nebr.

[73] Assignee: Optek, Inc., Galena, Ohio

[21] Appl. No.: 588,077

[22] Filed: Sep. 24, 1990

[51] Int. Cl.[5] ..... F26B 21/00; F26B 17/12; F26B 25/22; F26B 3/14

[52] U.S. Cl. ..... 34/54; 34/52; 34/53; 34/56; 34/89; 34/174; 34/175

[58] Field of Search ..... 34/52, 53, 54, 56, 89, 34/174, 175

[56] References Cited

U.S. PATENT DOCUMENTS

| | | | |
|---|---|---|---|
| 3,149,650 | 9/1964 | Horst | 141/361 |
| 3,600,820 | 8/1971 | Klein | 34/174 X |
| 3,714,718 | 2/1973 | Sukup | 34/56 |
| 3,896,562 | 7/1975 | Zimmerman | 34/174 |
| 4,004,351 | 1/1977 | Sanneman et al. | 34/56 X |
| 4,269,632 | 4/1981 | Ahtianien | 324/61 |
| 4,270,280 | 6/1981 | McClaren | 34/48 X |
| 4,337,584 | 7/1982 | Johnson | 34/174 X |
| 4,583,300 | 4/1986 | Mast | 34/50 |
| 4,599,809 | 7/1986 | Parkes | 34/31 |
| 4,750,273 | 6/1988 | Parkes et al. | 34/30 |
| 4,896,795 | 1/1990 | Ediger et al. | 222/63 |
| 4,914,834 | 4/1990 | Sime | 34/174 X |
| 4,916,830 | 4/1990 | Braun et al. | 34/48 |

*Primary Examiner*—Henry A. Bennet
*Assistant Examiner*—C. Kilner
*Attorney, Agent, or Firm*—John A. Beehner

[57] ABSTRACT

The grain moisture sensor of the present invention includes a plurality of conductors for communicating a variable voltage between two points. The conductors are mounted on the continuous flow dryer wall between the exterior and interior walls, in the heat plenum and oriented such that the grain flows between the conductors in response to the action of the variable discharge means. The sensor further includes electrical circuitry for measuring the capacitance of the conductor, calculating the percent moisture content of the grain and controlling the speed of a discharge means so as to control the discharge of grain from the dryer in response to the moisture content of the grain being lowered to a predetermined level.

8 Claims, 18 Drawing Sheets

MOISTURE SENSOR FOR A CONTINUOUS FLOW DRYER

BACKGROUND OF THE INVENTION

Continuous flow dryers are well known in the art and are available in a variety of designs, all generally including the following elements: (1) interior and exterior walls between which moist grain to be dried flows; (2) such moist grain being fed by an input means at the dryer top and flowing downwardly between the walls to a variable discharge means located substantially at the bottom of the dryer; (3) the interior walls partially defining a heat plenum into which hot air flows; (4) the interior and exterior walls each having numerous holes through which hot air from the heat plenum flows, which hot air is operative to reduce the moisture content of the grain flowing therebetween; and (5) the speed of the discharge means being variable such that the amount of time the grain drys, and thereby its final moisture content, is a function thereof.

The present invention is directed generally to a grain moisture sensor for use in determining the moisture content of grain and more specifically to a grain moisture sensor capable of determining grain moisture content and controlling the flow of grain in a continuous flow grain dryer by varying the speed of the variable discharge means such that the flow therein is regulated by the sensor, thereby allowing sufficient drying action to reduce the grain moisture content to a predetermined level, prior to being discharged therefrom.

The earliest electronic grain moisture testers were operated by direct current conductance. This method is accurate if moisture content is consistent throughout the kernel but rapid drying causes the outside of the kernel to be drier than the center, thereby providing inaccurate results.

There are also several known ways to measure grain moisture content by oven drying. The fastest of these methods, however, requires three hours and a grinding of the grain which are unacceptable for an on-line control system.

The Karl Fischer titration method is a chemical test which is specific for water. This is probably the most accurate moisture measurement method but it would likewise, not be practical for an on-line control system.

Microwave attenuation, while very accurate, is unsuitable because it is based on the dielectric loss factor which is not as consistent or well defined as the dielectric constant. Accordingly, expensive research would be required in order to develop a microwave based attenuation method.

Additionally, prior art teaches measurement of grain moisture content by measuring the temperature of the grain during the drying process, the moisture content of the grain being inferred from the grain temperature. This method, although simple, is not accurate due to the lack of a precise correlation between grain temperature and moisture content. This may result in grain which is overdry or underdry.

Another method taught by the prior art is to conduct the measurement in the discharge auger of the dryer. This method may be effective at determining the moisture content of the grain but the measurement is conducted at a point where it is too late to increase or decrease drying time as required. Consequently, it is more a means for grading the job done by the dryer than for affecting the proper drying.

Most electronic equipment used for measurement of moisture in grain is based on capacitance measurement. The capacitance of a given sensor depends on the dielectric constant of the grain in the sensor. Since the dielectric constant for grain is much lower than the dielectric constant for water, a small change in the amount of moisture in grain causes a relatively large change in its dielectric constant. This change in dielectric constant with grain moisture content makes it ideal for use in measuring moisture content and controlling drying equipment.

Accordingly, it is a primary objective of the present invention to provide an apparatus which is capable of making an accurate determination of grain moisture content.

Another objective of the present invention is to provide a means for controlling the flow of grain in a continuous flow dryer so as to effect the proper amount of drying required to attain a predetermined moisture content.

Another objective of the present invention is to provide a method for measuring grain moisture content and controlling grain flow such that the determination of moisture content is made at a point in the flow where the rate of flow may be varied to allow for more or less drying of the grain being tested, if the moisture content measured exceeds or falls short of the predetermined level.

Another objective of the present invention is to provide a grain moisture sensor which is simple and rugged in construction, easy to install and operate and which is efficient in operation.

SUMMARY OF THE INVENTION

The grain moisture sensor of the present invention includes a plurality of conductors for communicating a variable voltage between two points. The conductors are mounted on the continuous flow dryer wall between the exterior and interior walls within the heat zone wherein hot air is passed through the grain. The conductors are oriented such that the grain flows between them in response to the action of the variable discharge means. If the conductors used are capacitor plates, they are mounted uniformly spaced apart, substantially vertical and in spaced relation from the wall such that the grain substantially fills the space between the plates. If the conductors are conducting rods, they are mounted in a substantially parallel relation to each other and in a substantially perpendicular orientation to the flow of grain such that the grain substantially fills the space between the rods. In either case, the conductors are mounted in the dryer's heat zone between the interior and exterior walls.

The sensor further includes an electronic circuit including means for measuring the capacitance and temperature of the conductors with grain between them. Control logic means is also electrically connected to the measuring means and operative to calculate the percentage moisture content of grain between the capacitor plates as a function of the capacitance and temperature of the conductors with grain between them. The control logic means is electrically connected to the variable discharge means for controlling its speed of operation as a function of the sensor's measurement of grain moisture content. The speed of the discharge means is therefore reduced when the measured moisture content exceeds a predetermined value, thereby allowing additional drying to take place. Likewise, the speed of the discharge means is increased when the measured moisture content is below a predetermined value, thereby decreasing drying time.

The capacitance measuring means may include an oscillator electrically connected to the conductors so as to produce an output frequency indicative of the capacitance thereof, a conversion means (such as a frequency to voltage converter) operative to measure the output frequency of the oscillator, convert the output frequency to a voltage level and communicate the voltage to the control logic means. The electrical circuit may further include temperature sensors and an analog-to-digital converter for communicating information to the control logic for accurately adjusting the calculation of percentage moisture content of the grain. The sensor apparatus may further include a control panel operative to communicate and display various data to and from the control logic means, and communication interface circuitry for communication with printers or other external devices.

Additionally, the present invention teaches a novel method for measuring the moisture content of grain and controlling the flow of grain in a continuous flow dryer such that grain of a consistent and predetermined moisture content is discharged therefrom. The steps of the method include: providing a grain moisture sensor of the present invention, installing the sensor in the heat zone of a continuous flow dryer; inputting the desired moisture content into the control logic; sensing the actual moisture content of the grain in the dryer; adjusting the speed of the variable discharge means to allow for further drying if the sensed moisture content exceeds the desired value or less drying if the sensed moisture content is less than the desired value.

Figure 15:
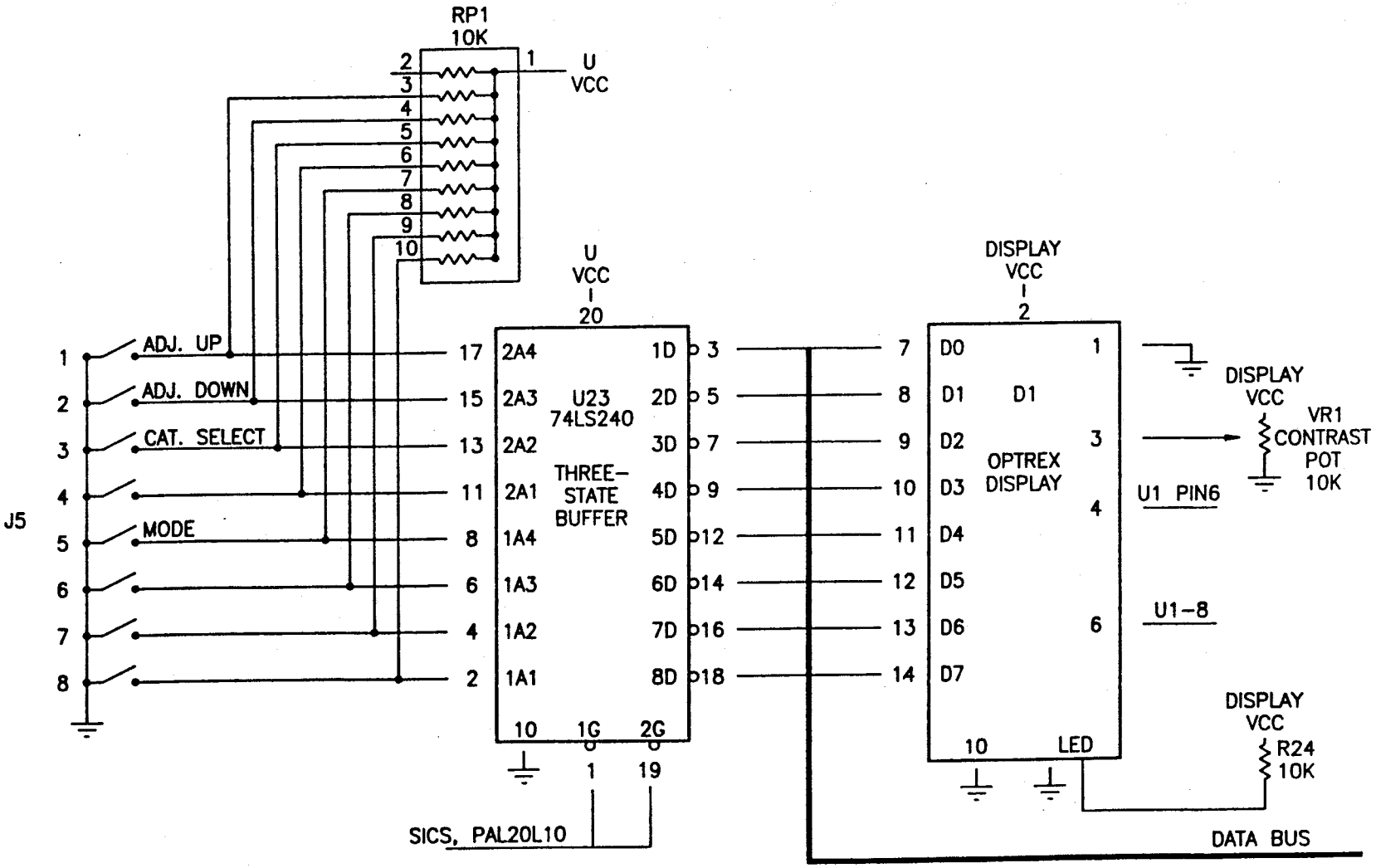
Figure 16:
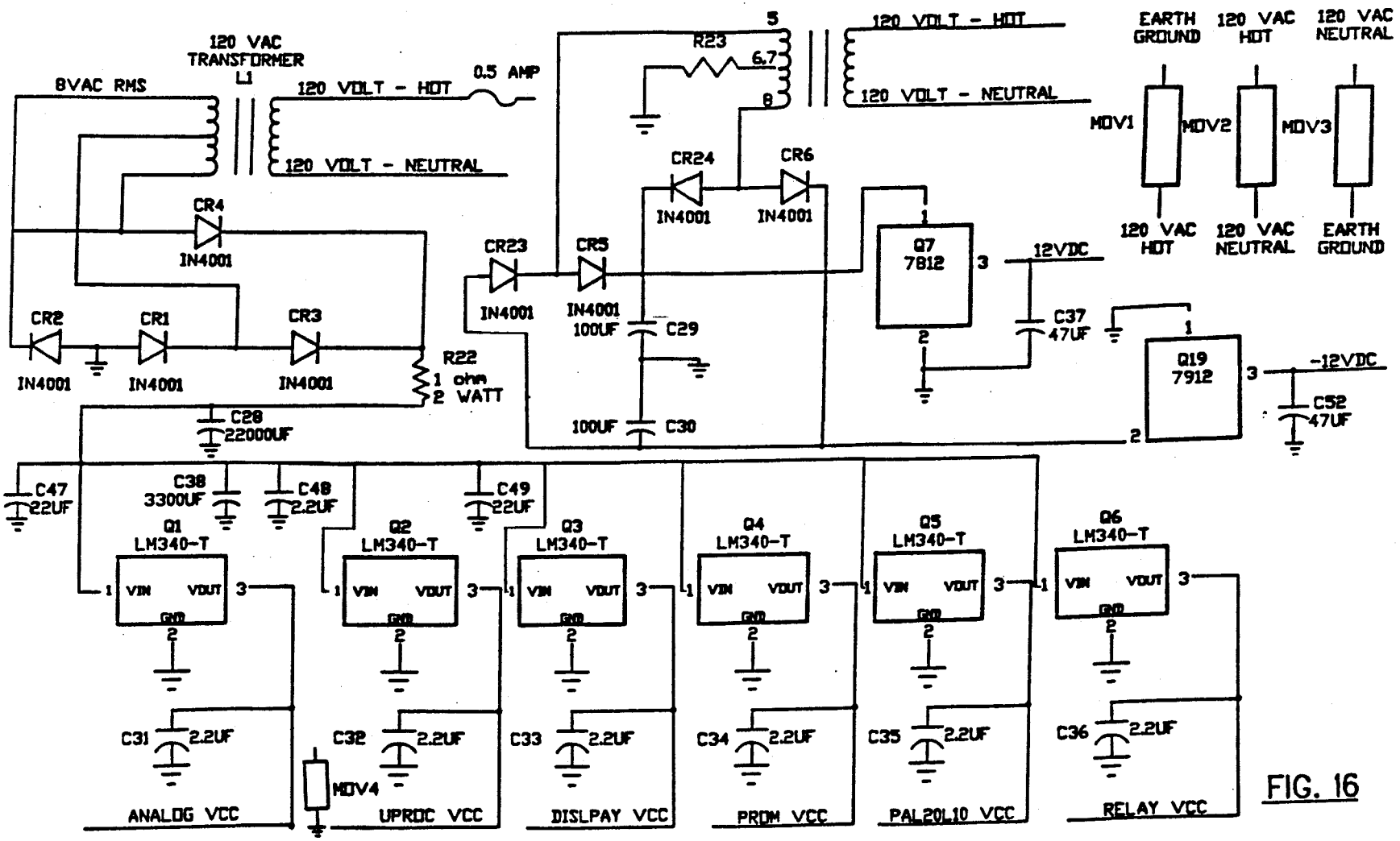
Figure 17:
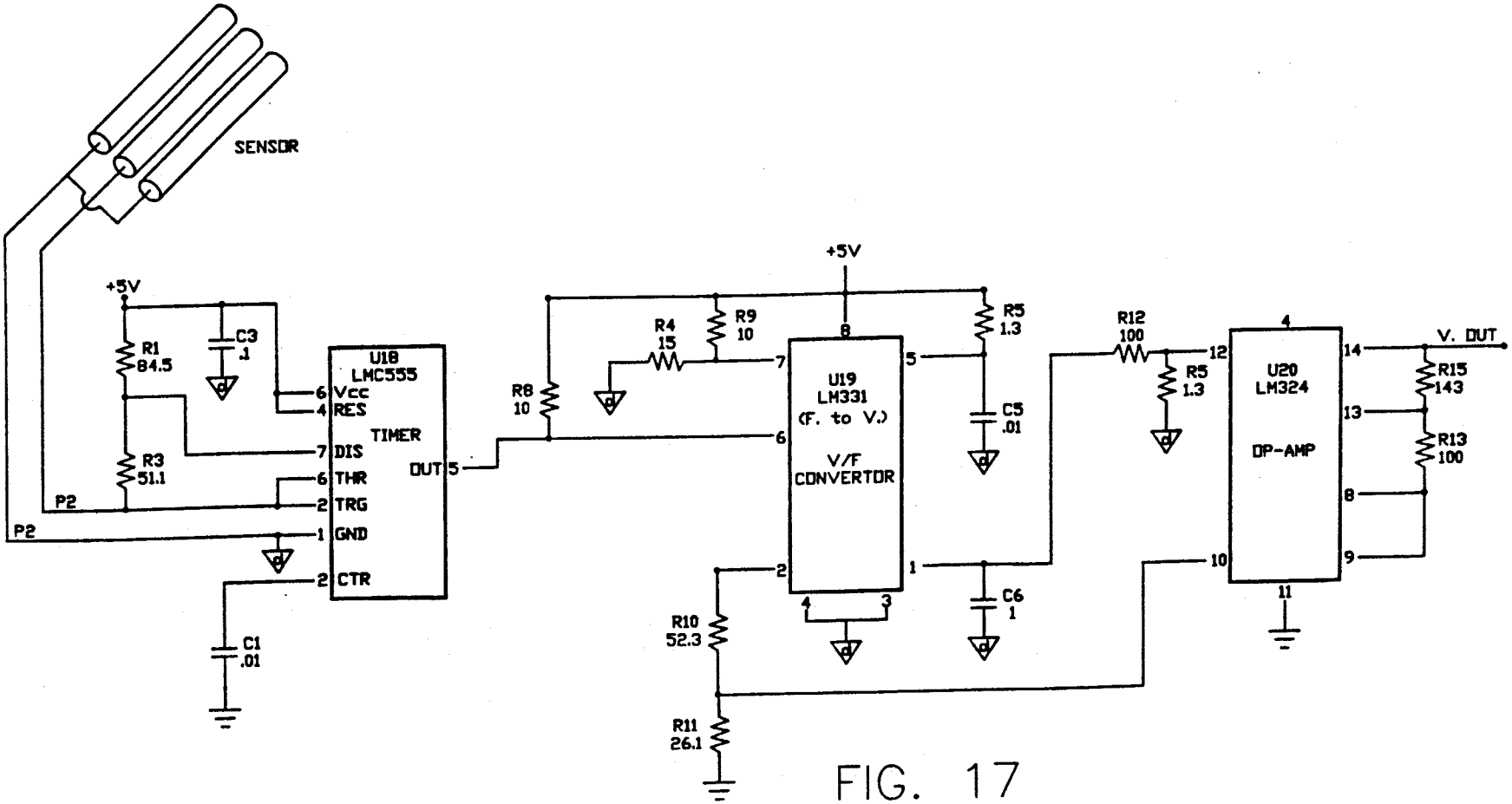
Figure 18:
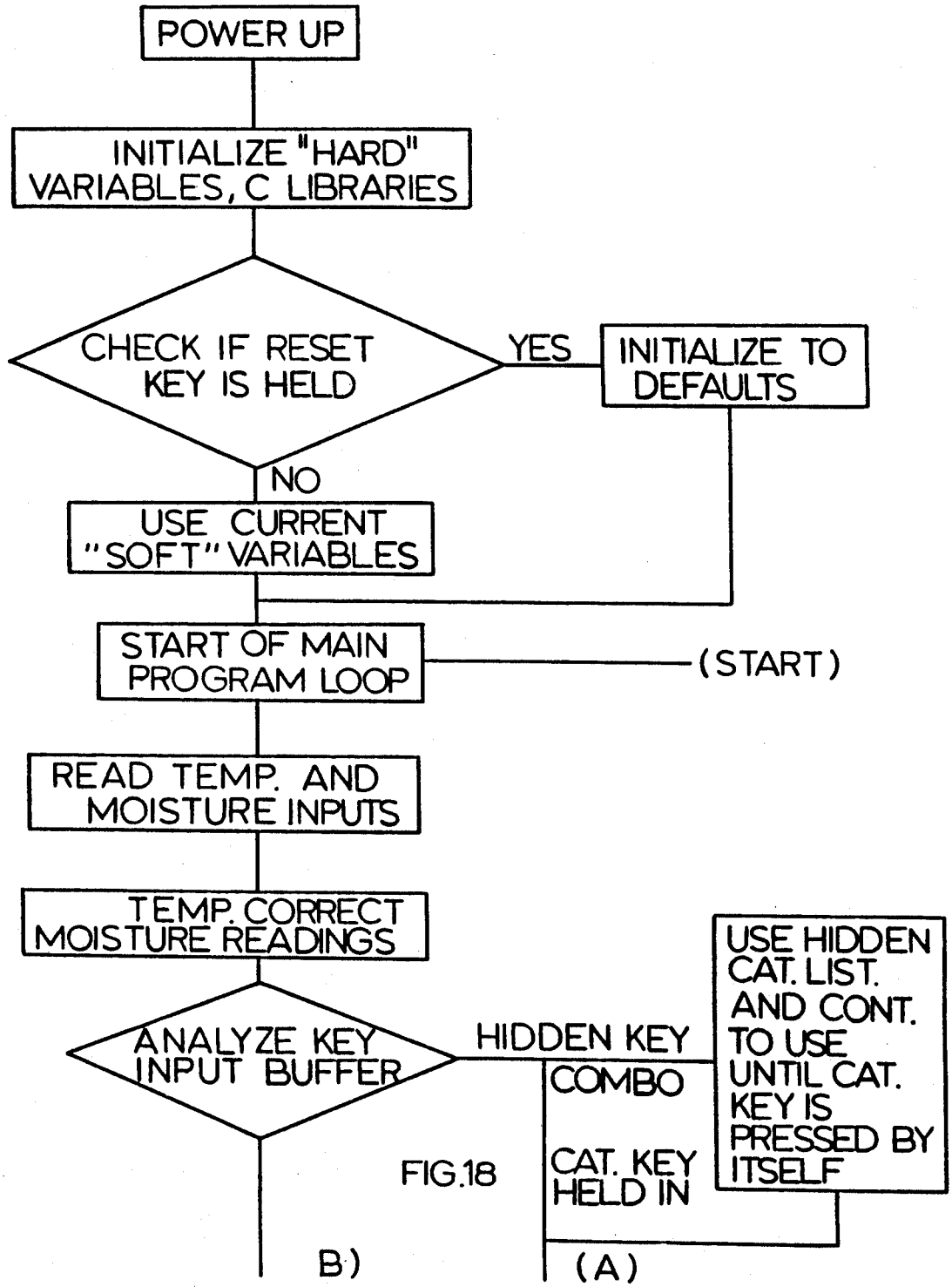
Figure 19:
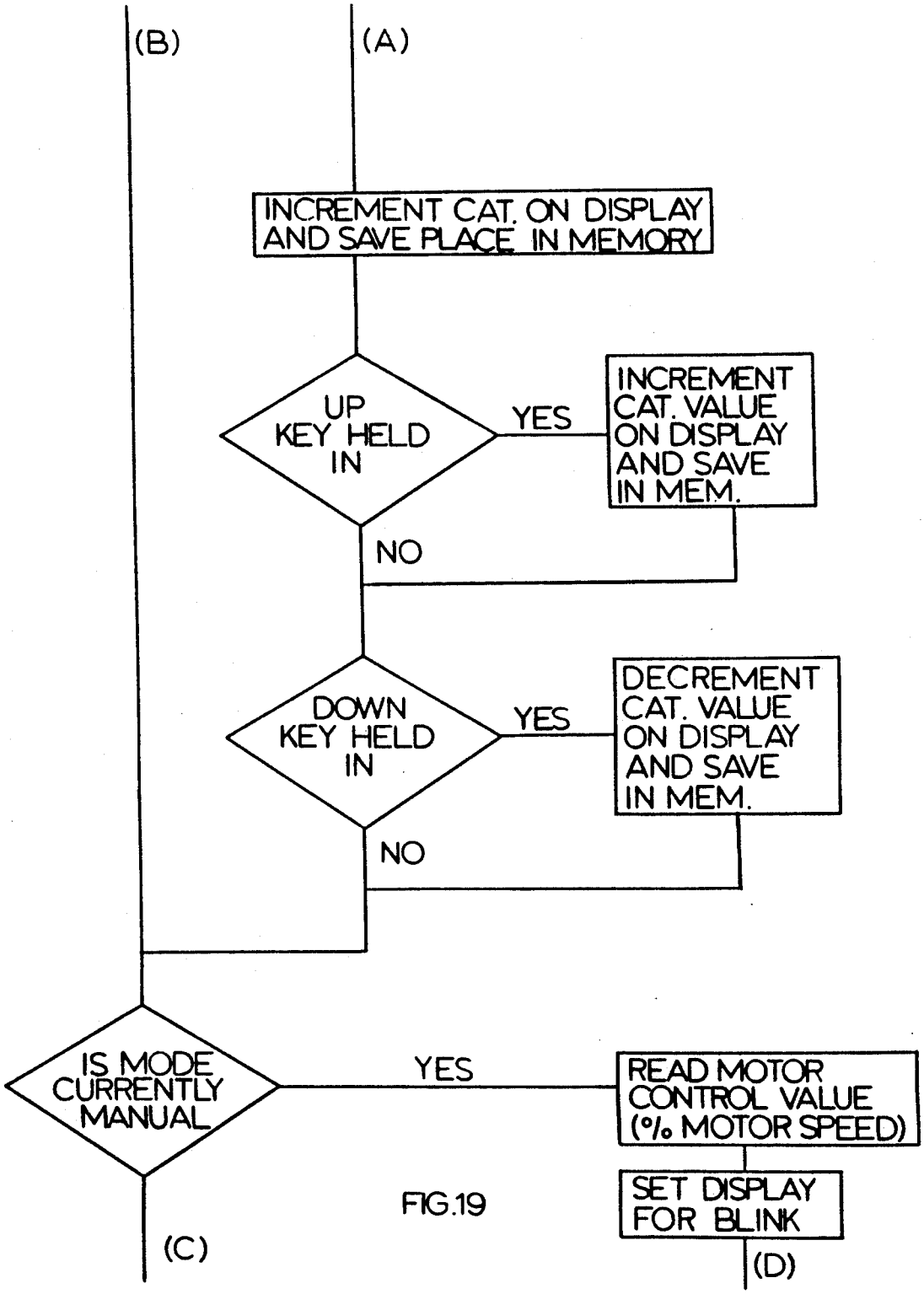
Figure 20:
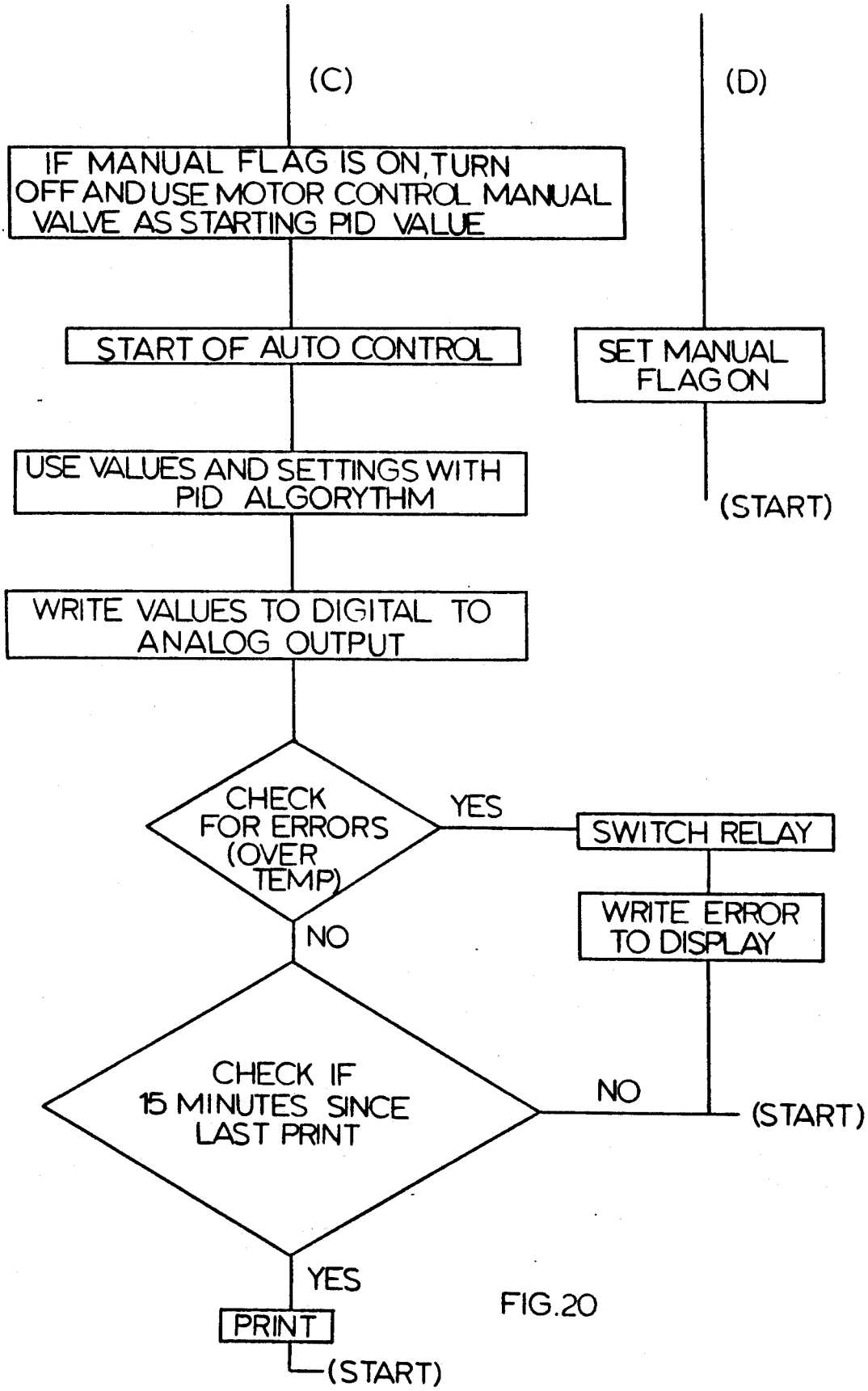

Together FIGS. 5, 6, 7, and 8 schematically illustrate the microprocessor, memory, power watch, and variable drivers circuitry and components;

Together FIGS. 9 through 14 schematically illustrate the microprocessor analog circuitry and components;

FIG. 15 is a schematic of the microprocessor switches and display circuitry and components;

FIG. 16 is a schematic of the microprocessor and related component power supply circuitry and components; and FIG. 17 is a schematic of the microprocessor remote sensor circuitry; and Together FIGS. 18, 19, and 20 diagrammatically illustrate a flow chart of the software installed in the sensor.

DESCRIPTION OF THE PREFERRED EMBODIMENT

Figure 1:
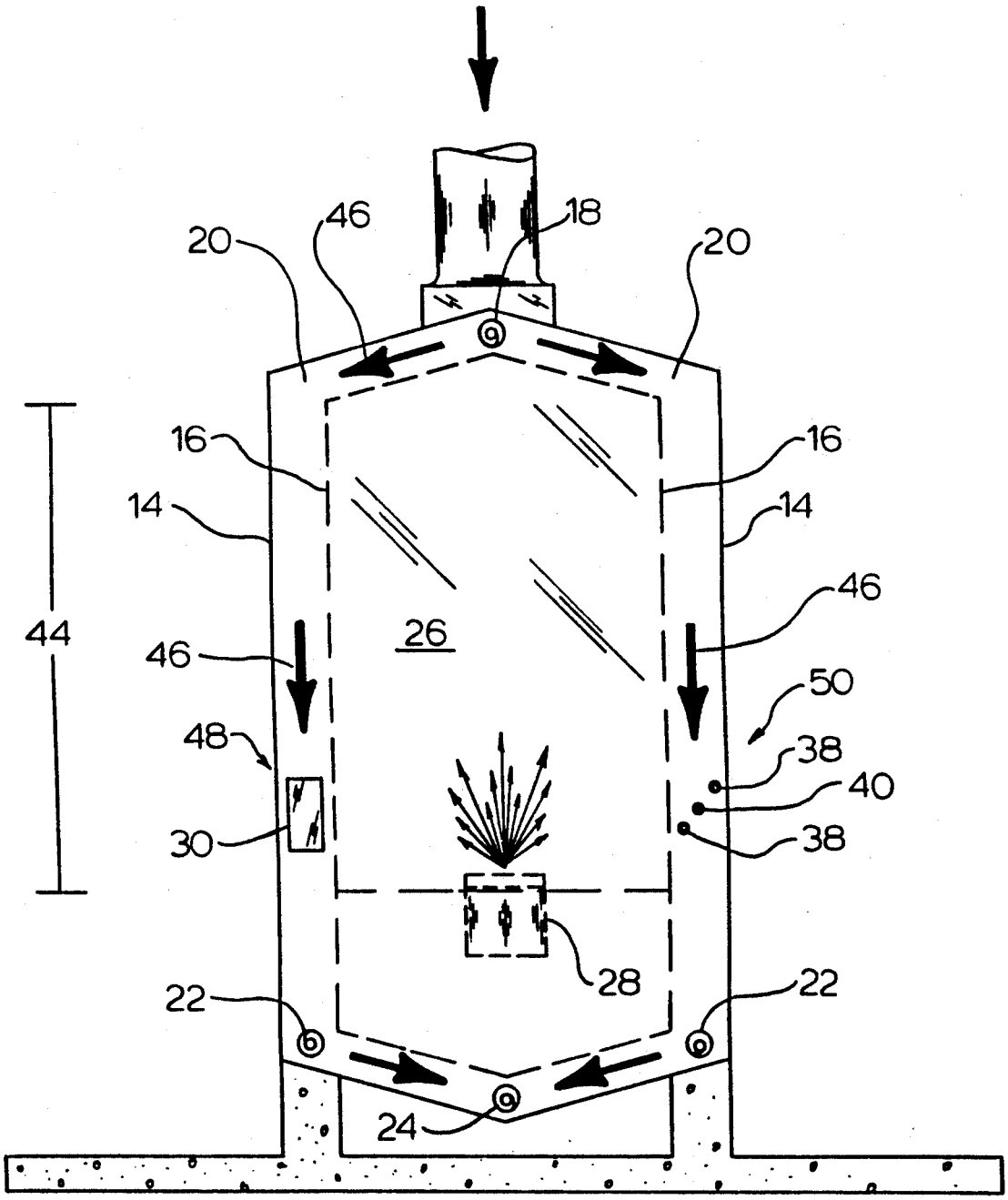
FIG. 1 is a front diagrammatic view of a conventional continuous flow grain dryer, showing numerous features of the dryer and showing the installation position of the grain moisture sensor's conductor rods or alternatively the conductor plates.
Figure 2:
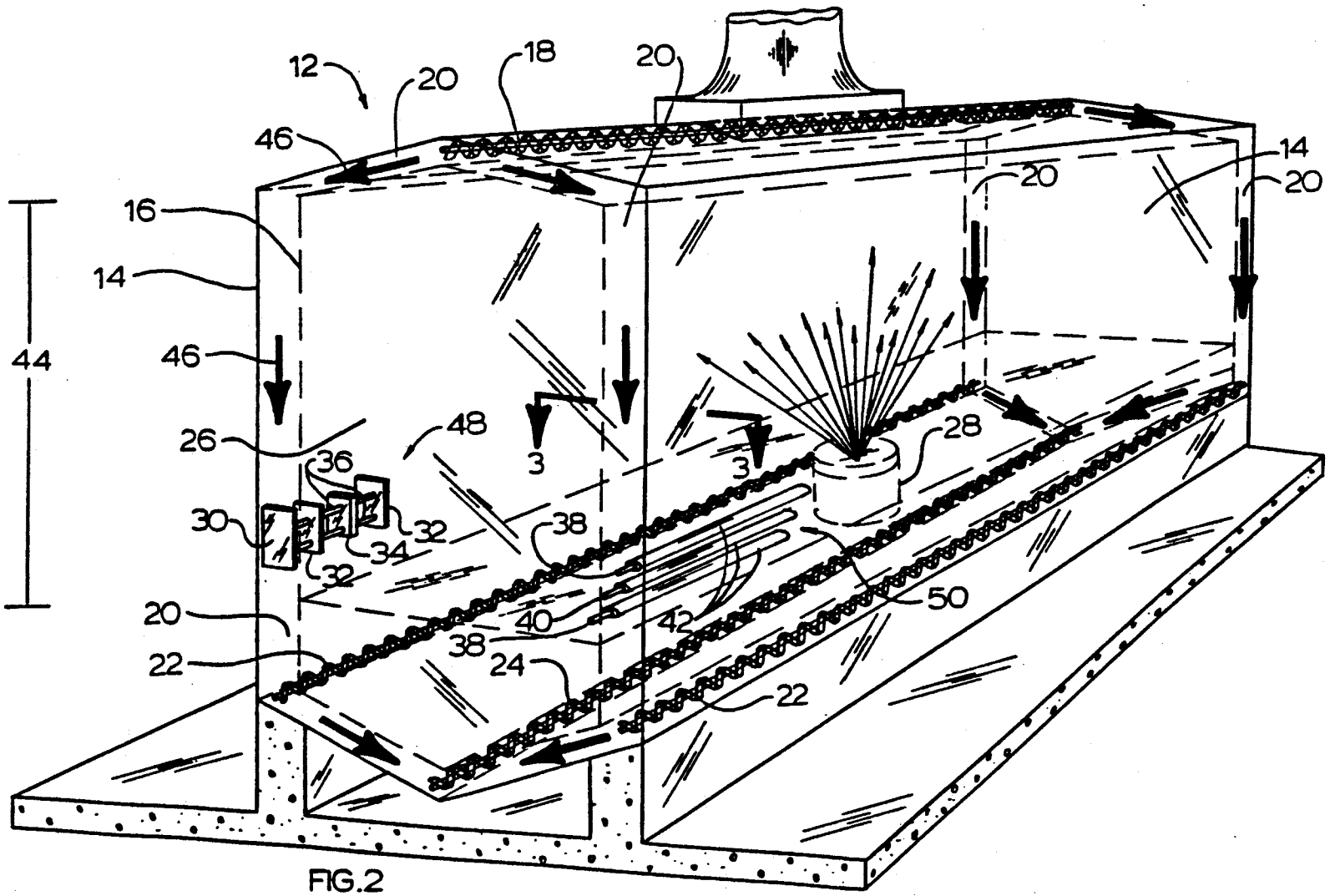
FIG. 2 is a front perspective view of the dryer showing both external and internal features of the dryer, installation of the sensor conductor rods or plates and especially how the conductor is mounted between the interior and exterior walls and in the heat zone.

The grain moisture sensor of the present invention is shown in FIGS. 1 through 20. FIGS. 1 and 2 show installation of the sensor's conductor alternatives (plates 48 or rods 50) on the front wall 56 of a continuous flow dryer 12. The continuous flow dryer 12 has spaced apart exterior walls 14 and interior walls 16 and between which walls is the grain flow path 20. The generally continuous flow of grain begins at the input means 18 located at substantially the top of the dryer 12.

The grain travels in the flow path 20, as shown by the arrows 46, between the interior walls 16 and exterior walls 14 from the input means 18 down the flow path 20 to the flow rollers 22. The speed of the flow rollers 22 is variable and controls the flow of grain into the discharge auger 24 which discharges grain from the dryer 12. The interior walls 16 partially define a heat plenum 26. A hot air source 28 is in communication with the heat plenum 26 and is operative to force hot air into the plenum.

The interior walls 16 and exterior walls 14 have numerous holes therein and through which holes, hot air from the heat plenum 26 flows as shown by arrows 52. The general vertical extent of the space between the interior walls 16 and the exterior walls 14 through which hot air from the plenum 26 flows is referred to as the heat zone 44 and is where the drying of the grain occurs.

The feed rollers 22 control the rate of grain flow in the heat zone 44 and consequently the amount of time the grain remains in the heat zone 44. Since the final moisture content of the discharged grain is a result of the amount of time the grain is in the heat zone 44, the final moisture content of the grain can be controlled by regulating the speed of the flow rollers 22.

FIGS. 1 and 2 show the installation position of the sensor conductor rods 50 or alternatively conductor plates 48. In the preferred embodiment, the conductor capacitor rods 50 are attached to the front wall 56 (FIG. 3) of the dryer 12 and positioned between the internal 16 and external 14 walls. The rods 50 are positioned vertically to be within the heat zone 44 (FIGS. 1 and 2), approximately one and one-half feet above the floor of the heat zone.

If the sensor conductor is a pair of capacitor plates 48 (FIG. 2), the plates are mounted on the front dryer wall 56 with an attachment plate 30 (FIG. 1). The capacitor plates 48 are also mounted so as to be between the internal 16 and external walls 14 and within the heat zone 44.

This positioning of the sensor conductor (plates or rods) within the heat zone 44 and in the grain flow 20, allows the determination of the grain moisture content to be made at a point in the flow path 20 where additional drying of the grain may be affected, by slowing the speed of the flow rollers 22 causing the grain to remain in heat zone 44 for a longer time.

Figure 3:
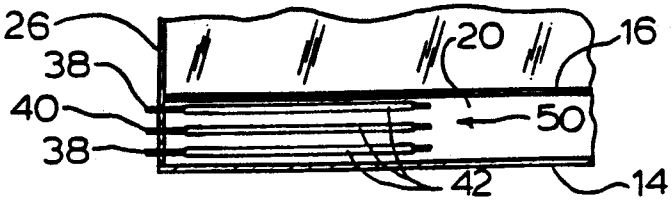
FIG. 3 is a top view of the preferred sensor conductor installation showing how the rods are mounted between the dryer walls and in the grain flow path.

FIG. 3 shows a top view of the capacitor rods 50 installation. Shown is the orientation of the rods 50 as they would appear to grain flowing in path 20. As is clear from the figure, grain flowing in path 20 would flow between the rods and substantially fill the space therebetween. In the preferred embodiment the capacitor rods 50 will include a source rod 40 and two ground rods 38 with all three rods having an insulating coating 42. The ground rods 38 are electrically connected to each other but electrically isolated from the source rod 40, so that a varying electrical potential may be applied between the source 40 and ground rods 38.

In the preferred embodiment, the conducting and ground rods will be approximately eight foot lengths of one-half inch diameter copper tubing spaced six to eight inches apart. The rods could be factory installed in prefabricated holes in the dryer column walls 54 (FIG. 3), and are secured to the front wall 56 of the dryer 12 by means of suitable nuts or the like.

As seen in the perspective view of FIG. 2, the capacitor rods 50 are also vertically spaced. This allows for greater separation of the rods than could be accommodated by the distance between the interior 16 and exterior 14.

FIG. 2 shows installation of the alternative sensor conductor, the capacitor plates 48, on the dryer front wall 56. It is envisioned that the capacitor plate conductor will be used when the sensor is to be installed on existing grain dryers. The capacitor plates 48 are secured in place by means of an attachment plate 30. The plate 30 is insulated from the dryer wall 56 by a fiberglass pad or the like placed therebetween. A pair of bolts extend inwardly from the plate 30 and through the two ground plates 32 and through the source plate 34. The ground plates 32 are electrically connected to each other but electrically isolated from the source plate 34 and from the attachment plate 30 by means of fiberglass spacer tabs 36 or the like, so that a varying electrical potential may be applied between the source 34 and ground plates 32. Note that the capacitor plates are mounted in a uniformly spaced and substantially vertical relation to allow the grain flowing down the grain path 20 to flow between the plates and substantially fill the space therebetween.

The capacitance method for moisture testing of grain works by measuring the electrical characteristic known as permittivity ($\epsilon$). The permittivity is made up of the dielectric constant and the dielectric loss factor and can be calculated by knowing the capacitance of the sensor. The capacitance of the sensor is determined by constructing an RC (resistance-capacitance) oscillator with a known value of R and unknown value of C. The output frequency of the oscillator is therefore determined by the value of C and by finding the oscillator frequency, the value of C can be deduced. Thus, finding the capacitance of the sensor determines permittivity which is indicative of the moisture content of the grain surrounding the sensor.

Figure 4:
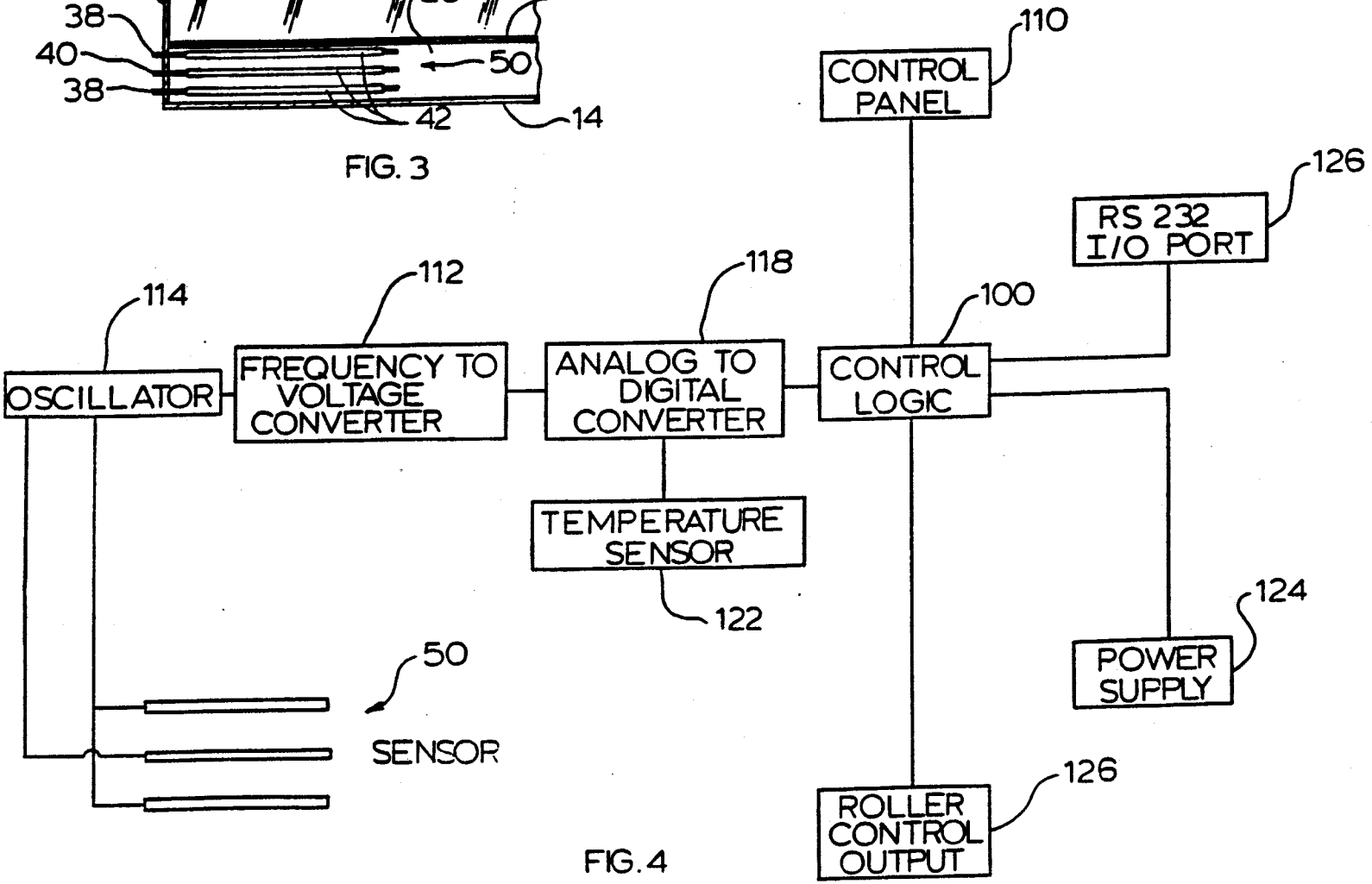
FIG. 4 is a block diagram of the grain moisture sensor's electrical circuitry.

FIG. 4 is a block diagram of the electrical circuitry for the grain moisture sensor. The control panel 110 is used to set the desired grain moisture content. The oscillator 114 is first used to generate a variable voltage, the frequency of which is used to determine the capacitance of the sensor. That capacitance determination is used by the control logic 100 to calculate the dielectric constant of the grain between the capacitor plates and thereby the moisture content of the grain.

The frequency-to-voltage converter 112 is used to convert the oscillator frequency to a voltage level. The analog-to-digital converter 118 converts voltage signals from the temperature sensor 122 and frequency voltage converter 112 to a digital binary signal the control logic 100 can use. A thermistor temperature sensor 100 is mounted interiorly of the bin adjacent conductor 50 for providing the temperature information used by the control logic 100 to compensate moisture content calculations for changes in grain temperature.

It is apparent that the heart of the grain dryer controller of the invention is the capacitor rods 50 mounted in the flow of grain which is being dried. The capacitor rods 50 use the grain between the rods as a dielectric material so changes in grain moisture change the capacitance of the rods. Since the capacitor is part of RC oscillator 114, changes in the rod's capacitance cause a change in the oscillator's output frequency.

The frequency-to-voltage converter 112 converts the oscillator's frequency to a voltage level which the analog-to-digital converter 118 uses to generate a digital binary signal the control logic 100 can use. Likewise, the analog-to-digital converter 118 uses the voltage signal from the temperature sensors 122 to generate a digital binary signal. The control logic 100 then takes this digital binary data and uses it to determine the moisture of the grain.

If the grain is above a preset moisture value, entered by the operator with the control panel 110, the control logic 100 commands the roller controller 120 to slow the flow rollers 22 (FIGS. 1 and 2). The slowing of the feed rollers 22 keeps the grain in the heat zone 44 (FIGS. 1 and 2) for a longer time and allows further drying.

If the grain is sufficiently dry the rollers are allowed to operate at full speed and the grain travels down the flow path 20 and is discharged from the dryer. The grain moisture sensor 10 is capable of varying the roller speed from 10% to 100% of full speed.

The electrical circuitry for effecting the above described operation is illustrated in FIGS. 5 through 17.

Figure 5:
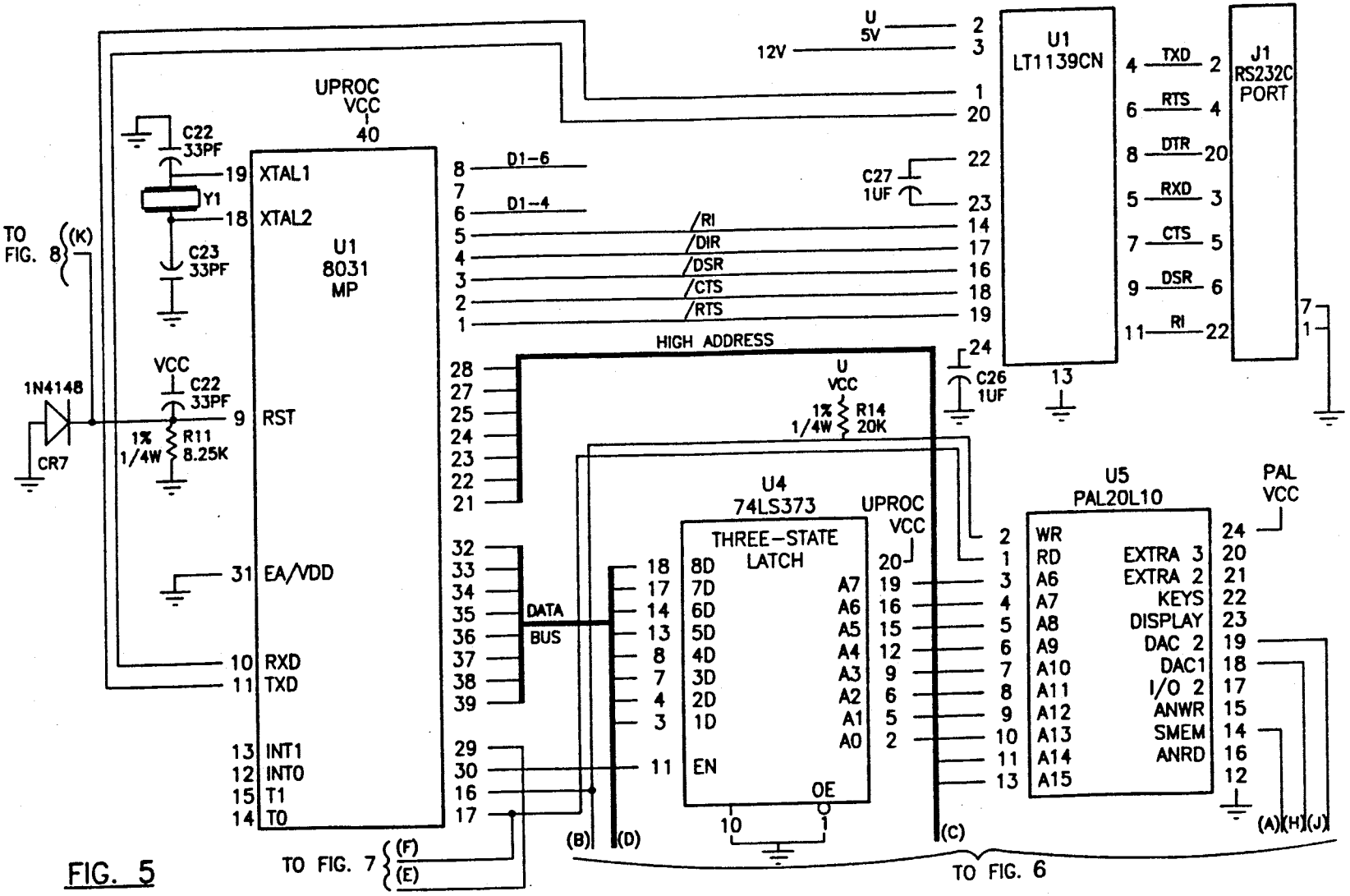
FIGS. 5 through 16 are composite portions of the detailed electrical circuit of the grain moisture sensor.

Illustrated are the sensor's microprocessor, memory, reset, I/O and motor control circuitry. The sensor's microprocessor U1 is an 8 bit 8031, running at a clock speed of 6 MHz. The microprocessor is responsible for executing all system instructions, gathering input data, making all calculations and directing all system communication (FIG. 5).

Figure 7:
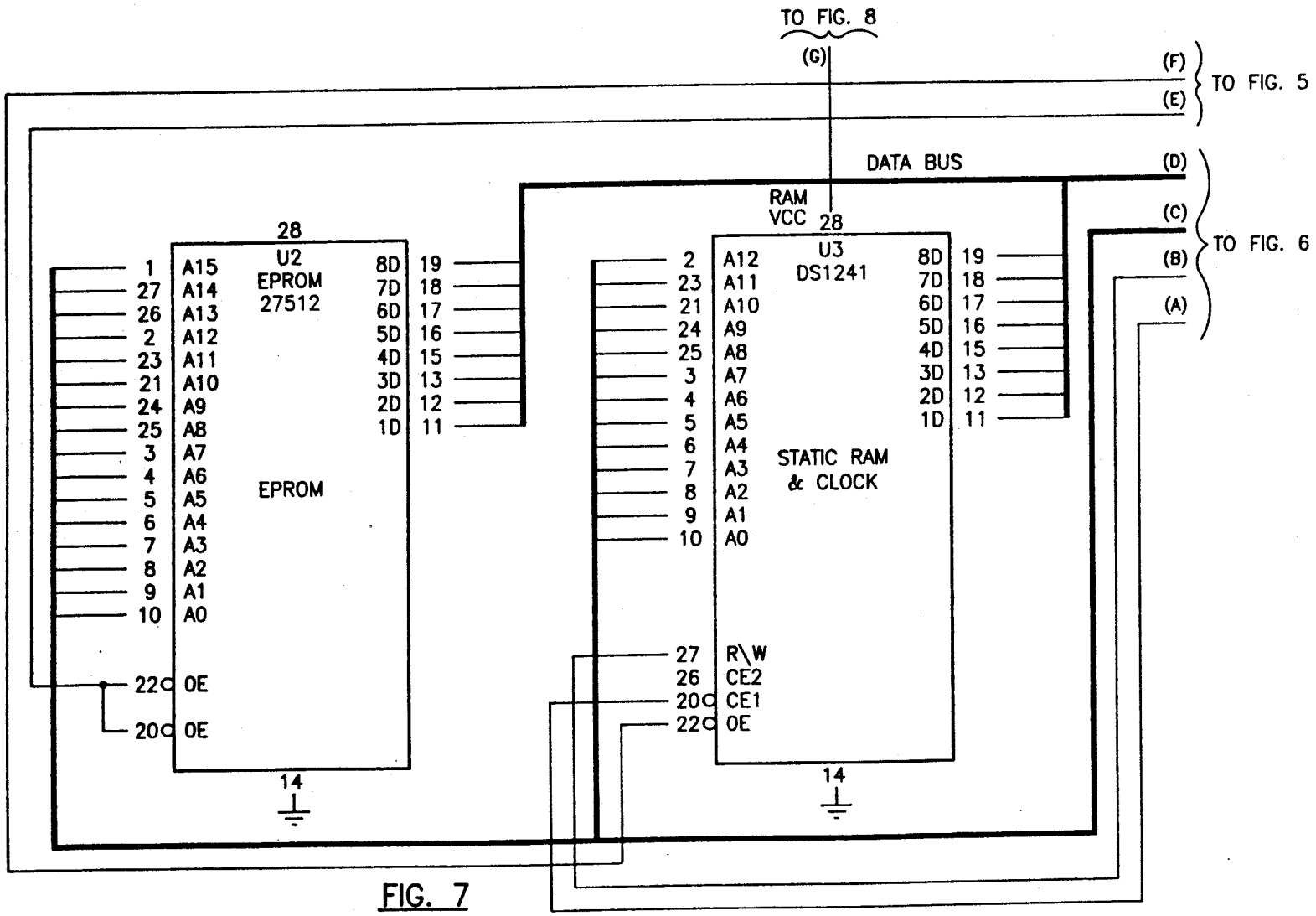

The system's software containing all instructions for system operation resides in U2 a 27512 Erasable Programmable Read Only Memory (EPROM). The EPROM U2 has data storage capacity and is programmed with the system software prior to installation in the circuit (FIG. 7).

The EPROM is connected to the microprocessor U1 by the data and address lines. U12 is a DS 1241 static RAM chip used for temporary storage of data such as system variables, calculation results and the like. Also contained within U12 is a real time clock whose operation is transparent to the RAM and which allows data to be tagged with the time of occurrence (FIG. 7). The 8031 microprocessor U1 multiplexes the lower eight address lines and the eight data lines.

U4 is a 74LS373 three-state latch which, when triggered by the microprocessor, latches and holds the lower eight bits of the address on the bus for system use. When the lower eight bits of the address bus are not required, U4 is disabled by the microprocessor and returns to its high impedance transparent mode. The bus is then free to be used for data transmission (FIG. 5).

The 8031 microprocessor U1 utilizes a memory mapped I/O architecture which means that I/O devices are treated as memory locations. When the microprocessor desires to read from or write to an I/O device, the device's address, including the lower eight bits, is placed on the bus.

Figure 6:
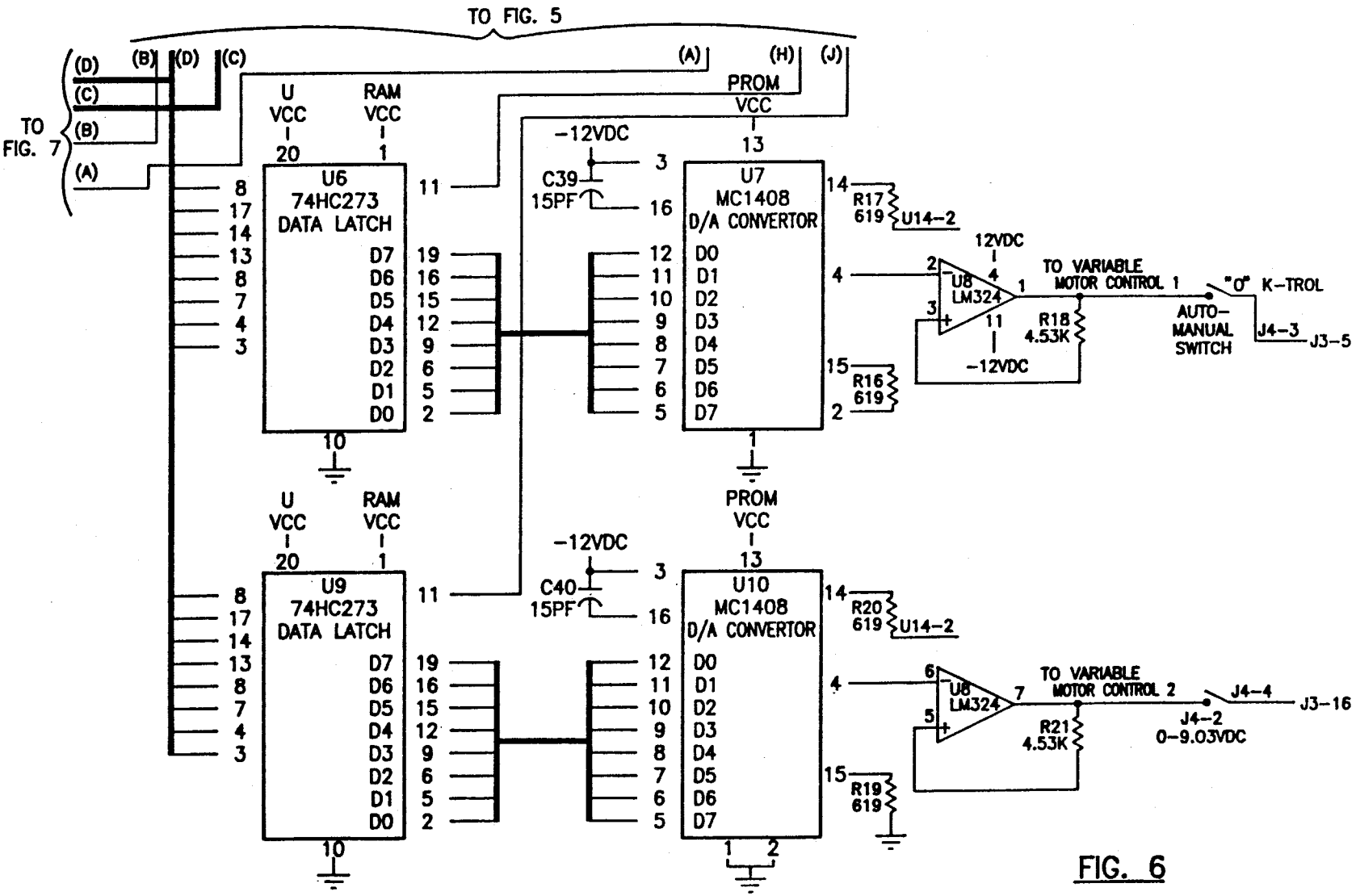

U5 is a Programmable Array Logic (PAL) chip which converts the binary address on the bus into a single enabling strobe. This enabling strobe is then used to differentiate between different I/O devices (FIG. 5). For example, FIGS. 5, 6, 7, and s show the interconnection between the microprocessor U1 and the motor control. When the speed of the feed roller motors is to be changed, the microprocessor U1 places the controller's address label on the address bus. At the same time, the microprocessor identifies the label as an address by activating the AE (address enable), U1 pin 30. This triggers the three-state latch U4 to latch the lower eight address bits. The PAL U5 then decodes the address on the bus and recognizing the binary bit pattern as being the motor controller's address, strobes U5 pin 18 which is electrically connected to pin 11 of data latch U6 (FIG. 6).

Strobing U6 pin 11 causes the data currently residing on the data bus to be latched by U6 and subsequently input to U7. U7 is a digital-to-analog converter (DAC) which converts the digital binary pattern from the data bus to an analog voltage which varies proportionally with the binary value of the data. The analog voltage is then fed to the U8 Operational Amplifier (Op-Amp) and then to the feed roller motor, the speed of which is proportional to its input voltage.

A similar sequence of events occurs when the microprocessor communicates with other I/O devices. The grain moisture sensor also includes provisions for another feed roller motor controller through ICs U9 and U10.

Figure 8:
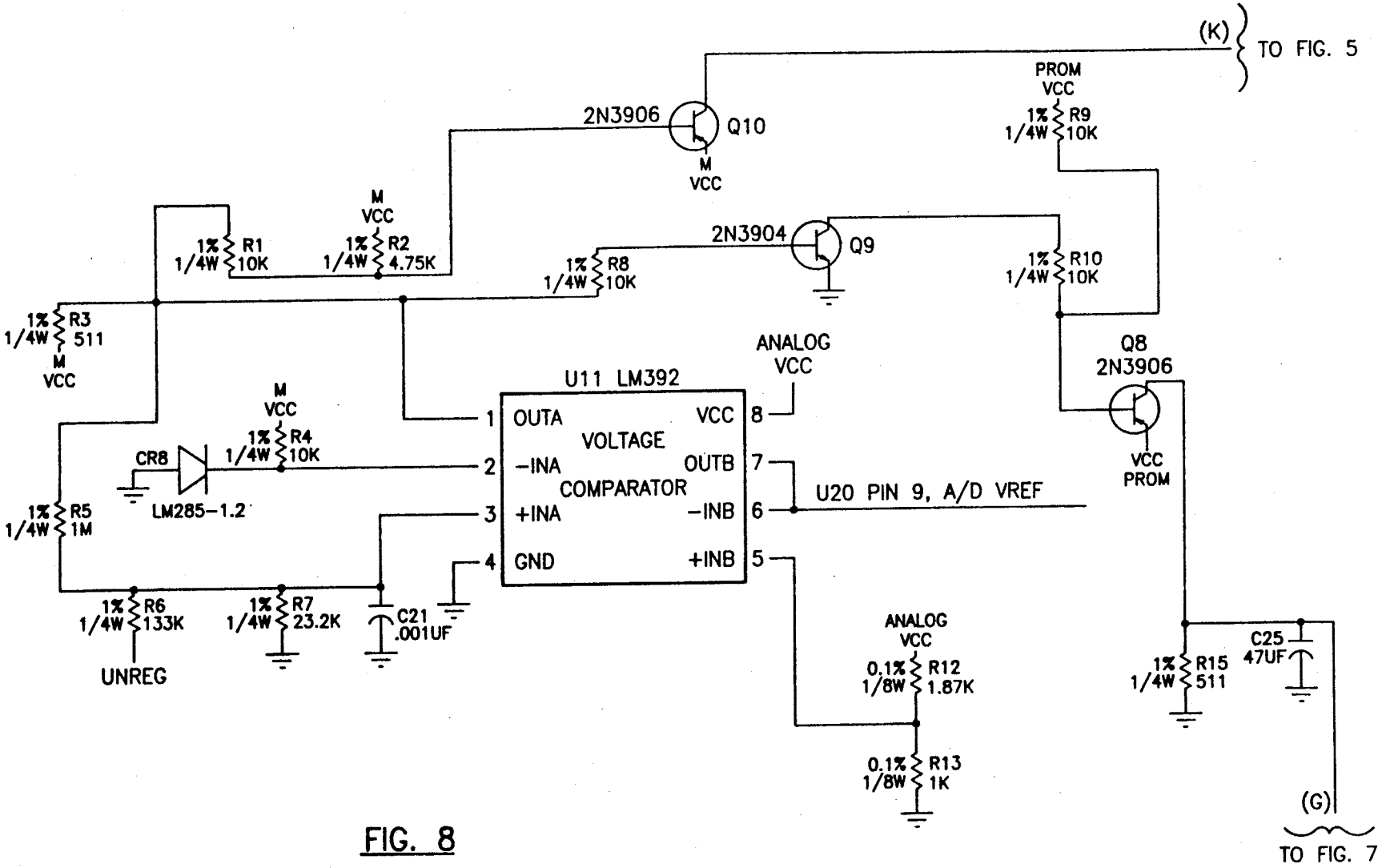

FIG. 8 also illustrates the system's power monitoring 11 capability. U11 is an LM392 voltage comparator which monitors system voltage. If the voltage begins to drop the RAM U12 is switched from system power to battery backup which saves the data stored in RAM and prevents the data from being contaminated during the power disruption. Also shown is the sensor's ability to communicate with external devices via the RS232 port J1. U1' is an LT1139 chip which converts communication data from the microprocessor U1 to the RS232 standard (FIG. 5).

Figure 11:
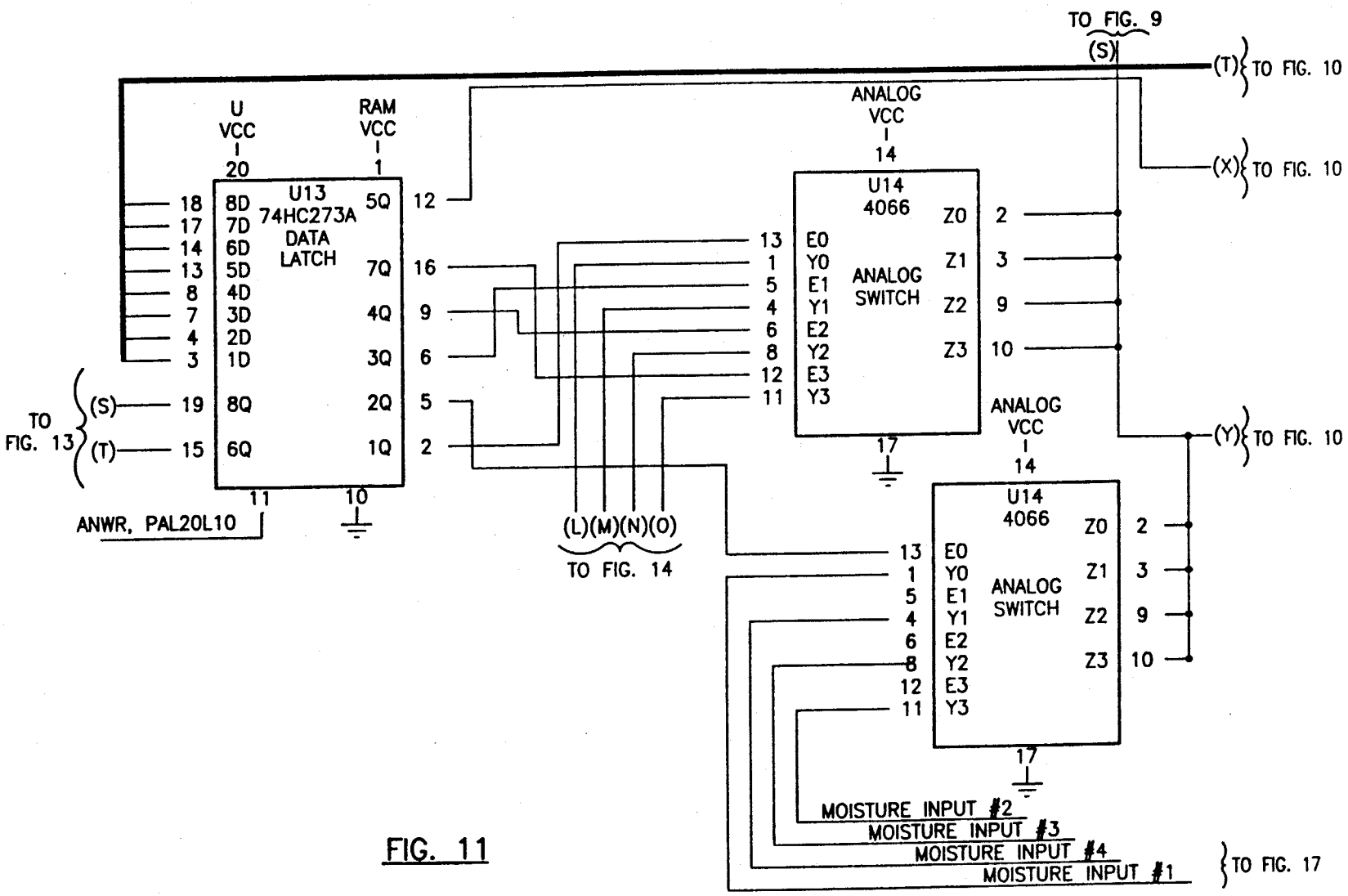

FIGS. 11 and 17 shows the interface with the temperature sensors and the moisture sensors. U13 is a 74LS272 data latch which controls data input from the temperature sensors and the moisture sensor. Similar to communication with the feed motor controller, the microprocessor U1 puts the sensor's address on the bus. The PAL chip U5 decodes the address and then enables the U13 chip. The data latch U13 controls two analog switches U14 and U15 which determine which temperature sensor or moisture sensor will present data to the microprocessor.

The temperature sensors are thermistors which vary current resistance in proportion to the temperature surrounding the sensor. This variance in resistance causes a voltage drop across a precision resistor which is fed through U16, an Op-Amp, to the analog switch U14. If the switch has been closed by the microprocessor, the voltage is fed to an analog-to-digital (A/D) converter U17 which converts the voltage to a binary digital pattern proportional to the voltage. This binary digital pattern is then placed on the data bus and read by the microprocessor U1.

FIG. 17 also shows the interface with the capacitance measurement sensor. U18 is an LM555 timer used as an oscillator. The frequency of the oscillations is directly related to the Values of R and C. Since R is a known quantity, in this case R1 and R2, the frequency of oscillation is wholly determined by the value of C. The value of C in turn, is determined by the moisture content of the grain in the sensor. In the preferred embodiment, the capacitor is a set of conducting rods 50 (FIG. 1). The rods are electrically connected to the timer U18 pins 2 and 6. The oscillator output, U18 pin 3, is connected to a frequency-to-voltage converter U19 which translates the oscillator output frequency to a voltage level. The voltage level is then fed to an Op-Amp U20 and then to the analog switch U15. When the microprocessor requests moisture data, the switch U15 is closed and the voltage data is input to the A/D converter U17 where it is converted to digital binary data for the microprocessor.

Figure 9:
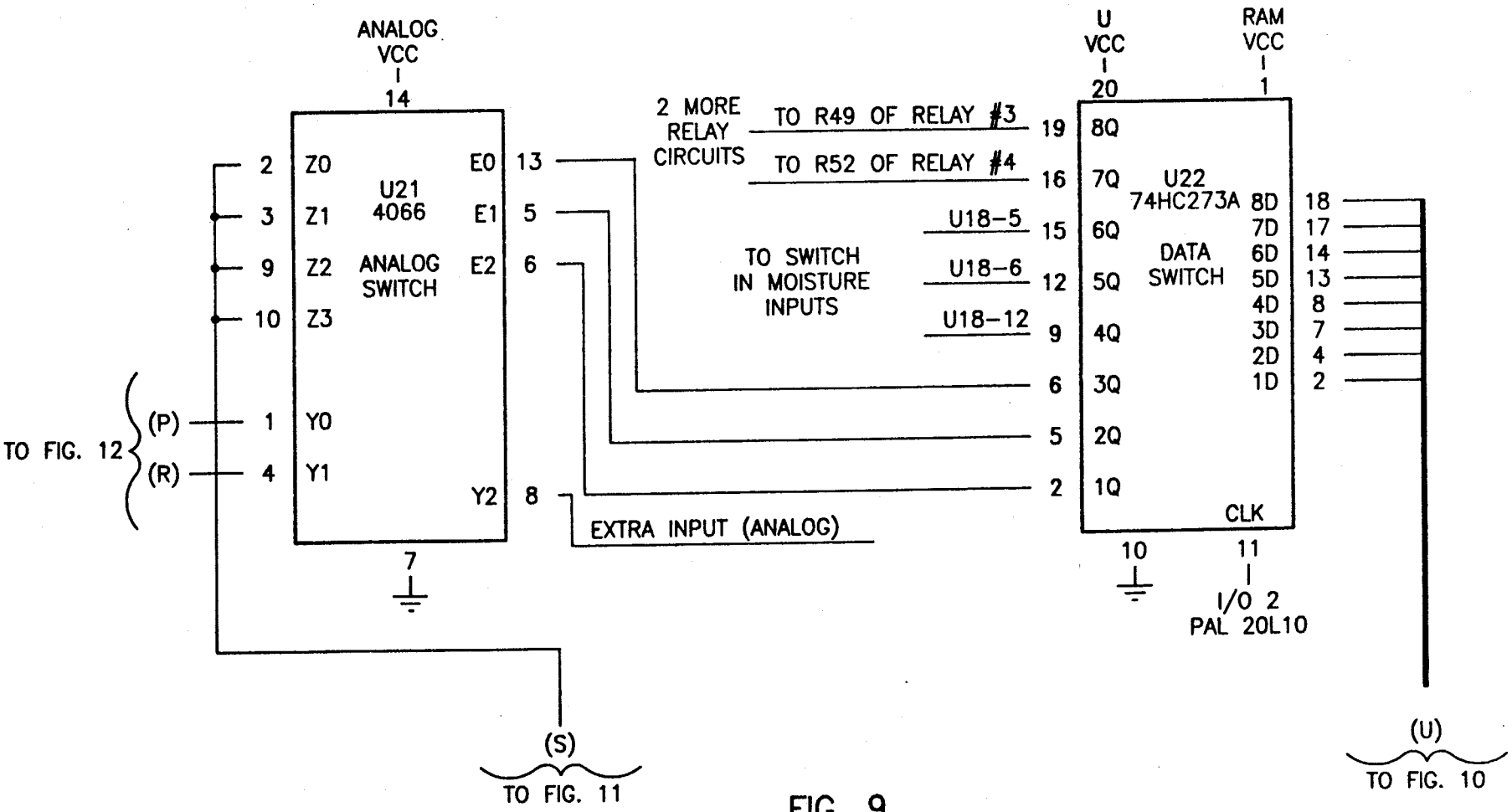
Figure 10:
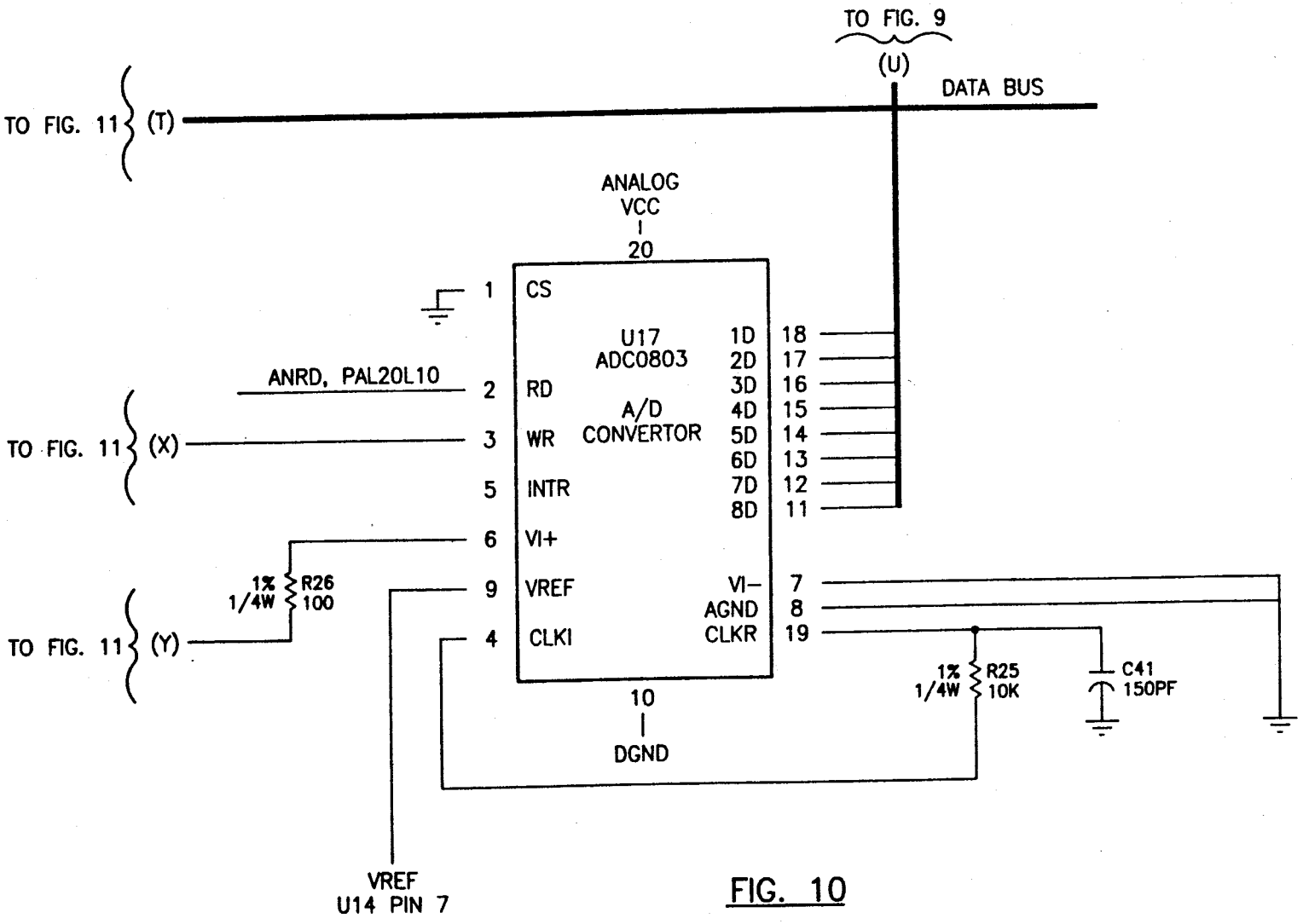
Figures 12, 13:
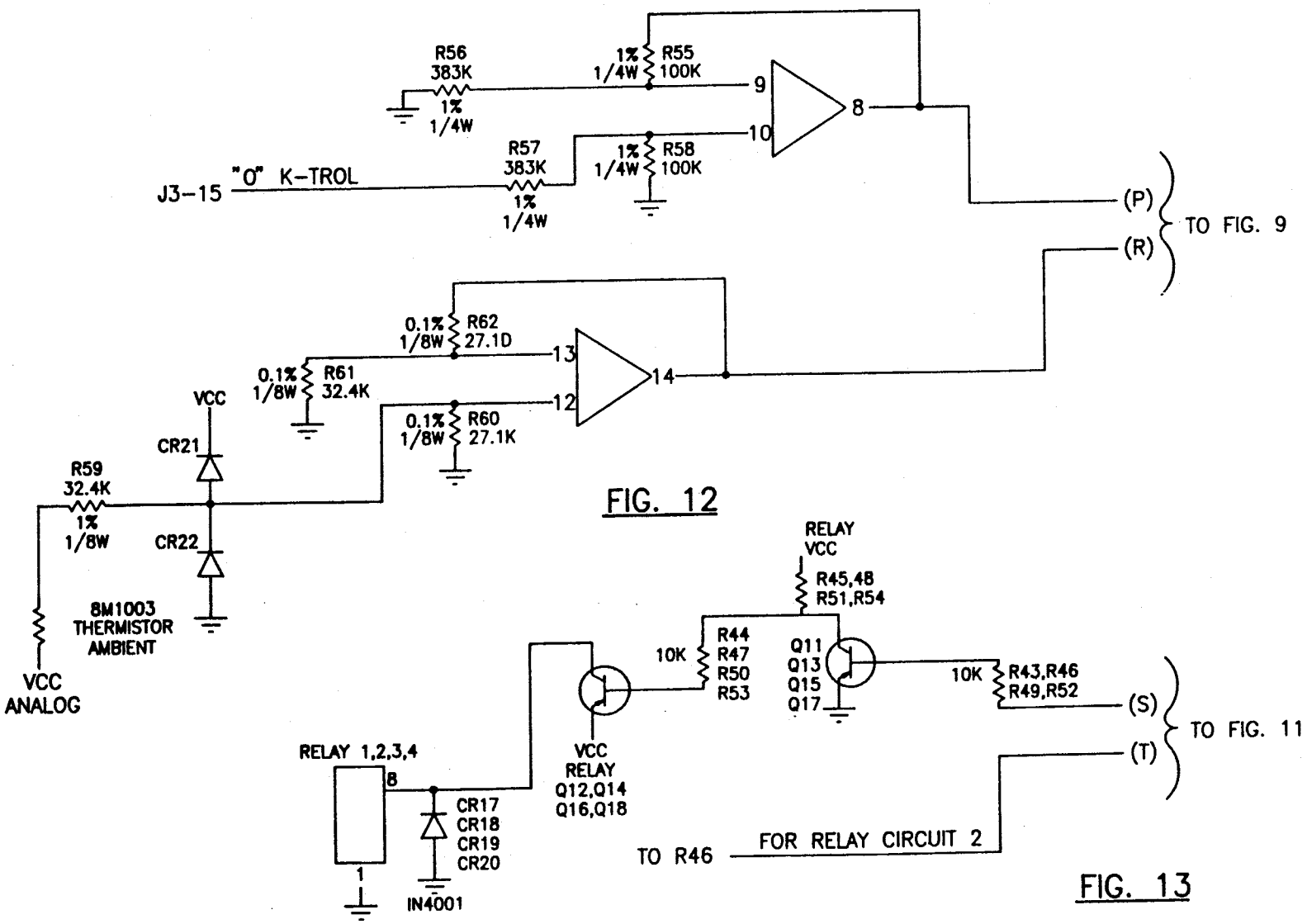
Figure 14:
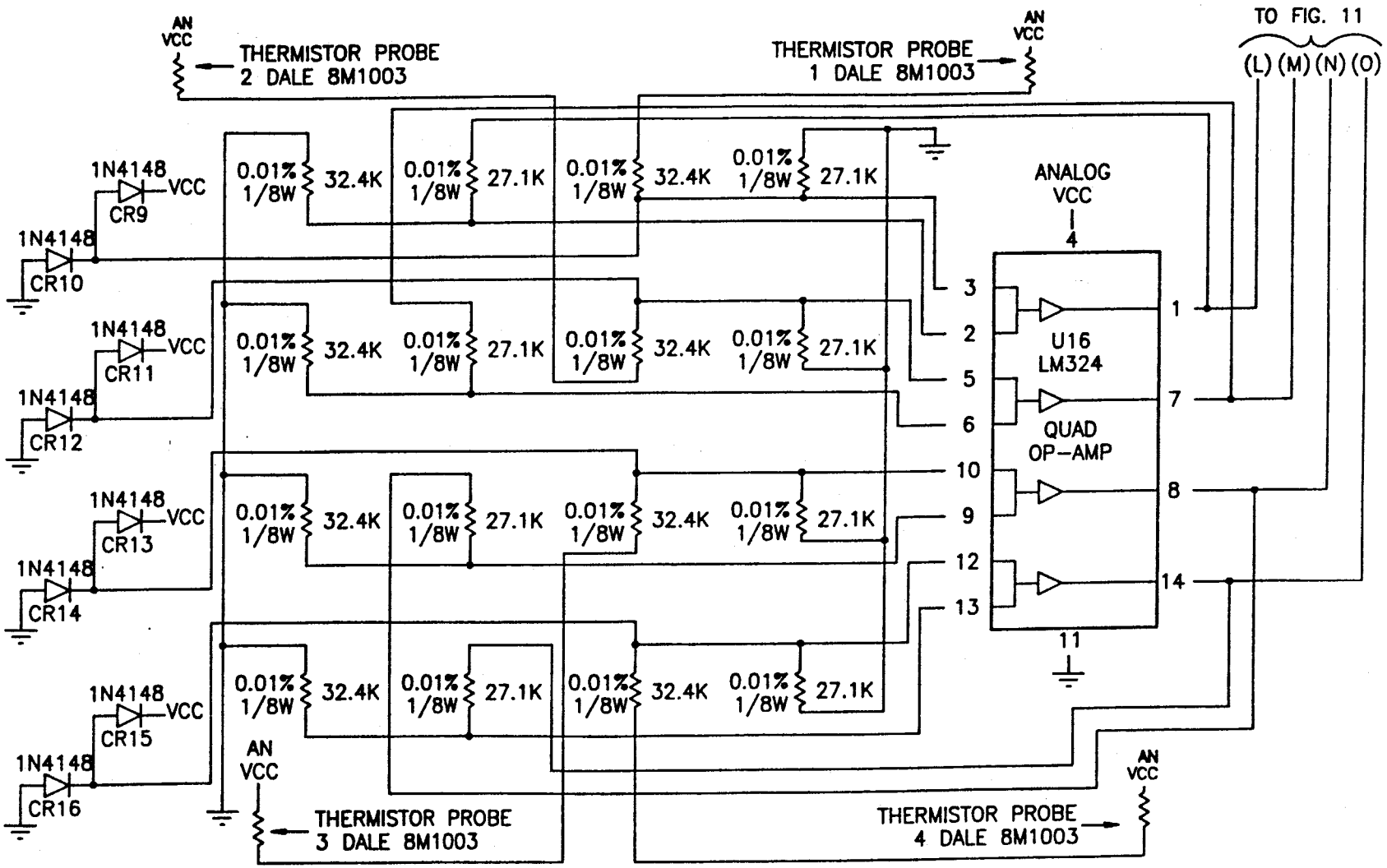

FIG. 13 shows how the microprocessor is able to read the roller motor speed using Op-Amp U8, analog switch U21 and data latch U22 (FIG. 9). Also shown in FIG. 11 is the connection of the latch U13 with relay circuits. The sensor uses the grain temperature information to determine if an overtemp condition exists within the dryer. If an overtemp condition is detected, the sensor removes power from the dryer blower and activates an alarm.

FIG. 15 shows the connection with the control panel and the display and the power supply for the grain moisture sensor. Communication with the control panel and the display is accomplished using a three-state buffer U23 for reading the panel switches at J1, and Optrex display D1 for displaying information to the operator. Addressing for communicating with the panel and the display is similar to other I/O devices. The power supply provides the system +12, −12 and +5 Volt DC from 120 VAC. The supply includes Metal Oxide Varistors for surge protection (FIG. 16).

Together FIGS. 18, 19, and 20 form a flow chart of the software stored in the EPROM U2 (FIG. 7) and used by the grain moisture sensor apparatus. This software contains all equations and instructions required by the microprocessor for accessing all temperature and moisture sensors, determining grain moisture content and communicating with all I/O devices, including the dryer feed roller motor controller. The software is programmed into the EPROM prior to its installation in the circuit.

Whereas the invention has been shown and described in connection with a preferred embodiment thereof, it is apparent that many modifications, additions and substitutions may be made which are within the intended broad scope of the appended claims. For example, various alternative microprocessors and associated architecture could be used as well as different I/O schemes.

Thus there has been shown and described a grain moisture sensor apparatus for use in a continuous flow dryer which accomplishes at least all of the stated objectives.

I claim:

1. A grain moisture sensor adapted for controlling the flow of grain in a continuous flow grain dryer having spaced apart exterior and interior walls, a generally continuous flow of grain between said exterior and interior walls, which flow is fed by an input means at the dryer top and flows down the length of the dryer walls to a variable discharge means, said interior walls partially defining a heat plenum, a source of hot air in communication with said plenum, said exterior and interior walls each having numerous small holes through which heated air from said heat plenum may flow, the general vertical extent of the space between said exterior and interior walls through which said hot air flows being referred to as a heat zone, said heated air flow being operative to reduce the moisture content of said grain flowing through said heat zone, said grain moisture sensor comprising:

a plurality of conductors for communicating a variable voltage between two points;

support means adapted for supporting said conductors in the heat zone of the dryer, and oriented in such a way as to allow the grain to substantially fill the space between said conductors and to flow between said conductors in response to the operation of said variable discharge means;

an electrical circuit including measuring means for determining the capacitance and temperature of said conductors, control logic means electrically connected to said measuring means and operative to calculate the percentage moisture content of the grain between said conductors as a function of said capacitance and temperature, said control logic means also electrically connected to said variable discharge means and operative to control the speed of said variable discharge means;

said plurality of conductors comprising at least one capacitor including at least a pair of substantially flat capacitor plates, mounted in a spaced relation from the walls, substantially parallel to each other and substantially vertically;

said measuring means including an oscillator electrically connected to said capacitor so as to produce a variable voltage of a frequency indicative of the capacitance of said capacitor with grain between plates whose moisture/dielectric properties change the overall capacitance of the sensor system and a conversion means for communicating said frequency level to said control logic means;

said conversion means including a frequency-to-voltage converter an analog-to-digital converter operative to convert said frequency to a voltage level and to communicate said voltage level to said control logic means;

a control panel mounted exteriorly of said dryer and electrically connected to said control logic means, said control panel including means for communicating to said control logic means desired grain moisture content, grain type, and fine calibration;

said control panel further including means for displaying moisture content information calculated by said control logic means; and said electrical circuit further including a communication means operative to effect communication between the sensor and external devices.

2. A grain moisture sensor adapted for controlling the flow of grain in a continuous flow grain dryer having spaced apart exterior and interior walls, a generally continuous flow of grain between said exterior and interior walls, which flow is fed by an input means at the dryer top and flows down the length of the dryer walls to a variable discharge means, said interior walls partially defining a heat plenum, a source of hot air in communication with said plenum, said exterior and interior walls each having numerous small holes through which heated air from said heat plenum may flow, the general vertical extent of the space between said exterior and interior walls through which said hot air flows being referred to as a heat zone, said heated air flow being operative to reduce the moisture content of said grain flowing through said heat zone, said grain moisture sensor comprising:

a plurality of conductors for communicating a variable voltage between two points;

support means adapted for supporting said conductors in the heat zone of the dryer, and oriented in such a way as to allow the grain to substantially fill the space between said conductors and to flow between said conductors in response to the operation of said variable discharge means;

an electrical circuit including measuring means for determining the capacitance and temperature of said conductors, control logic means electrically connected to said measuring means and operative to calculate the percentage moisture content of the grain between said conductors as a function of said capacitance and temperature, said control logic means also electrically connected to said variable discharge means and operative to control the speed of said variable discharge means;

said plurality of conductors comprising at least one capacitor including at least a pair of capacitor rods, wherein the rods are substantially cylindrical and are mounted substantially parallel to each other, said measuring means including an oscillator electrically connected to said capacitor so as to produce a variable voltage of a frequency indicative of the capacitance of said capacitor and a conversion means for communicating said frequency to said control logic means;

said electrical circuit further including a temperature sensor operative to measure the temperature of grain adjacent said capacitor, means for communicating said temperature to said control logic means, said control means being operative to adjust said percentage moisture content calculation to compensate for changes in temperature;

said conversion means including a frequency-to-voltage converter and an analog-to-digital converter operative to convert said frequency to a voltage level and to communicate said voltage level to said control logic means;

a control panel mounted exteriorly of said dryer and electrically connected to said control logic means, said control panel including means for communicating to said control logic means desired grain moisture content, grain type, and fine calibration;

said control panel further including means for displaying moisture content information calculated by said control logic means; and said electrical circuit further including a communication means operative to effect communication between the sensor and external devices.

3. In combination, a continuous flow grain dryer having spaced apart exterior and interior walls, a generally continuous flow of grain between said exterior and interior walls, which flow is fed by an input means at the dryer top and flows down the length of the dryer walls to a variable discharge means, said interior walls partially defining a heat plenum, a source of hot air in communication with said plenum, said exterior and interior walls each having numerous small holes through which heated air from said heat plenum may flow, the general vertical extent of the space between said exterior and interior walls through which said hot air flows being referred to as a heat zone, said heated air flow being operative to reduce the moisture content of said grain flowing through said heat zone;

a plurality of conductors for communicating a variable voltage between two points;

support means operative to support said conductors in the heat zone of the dryer, and oriented in such a way as to allow the grain to substantially fill the space between said conductors and to flow between said conductors in response to the operation of said variable discharge means;

an electrical circuit including measuring means for determining the capacitance of said conductors, control logic means electrically connected to said measuring means and operative to calculate the percentage moisture content of the grain between said voltage communication means as a function of said capacitance, said control logic means electrically connected to said variable discharge means and operative to control the speed of said variable discharge means;

said plurality of conductors comprising at least one capacitor including at least a pair of substantially flat capacitor plates, mounted in a spaced relation from the walls, substantially parallel to each other and substantially vertically;

said measuring means including an oscillator electrically connected to said capacitor so as to produce a variable voltage of a frequency indicative of the capacitance of said capacitor and a conversion means for communicating said frequency to said control logic means;

said electrical circuit further including a temperature sensor operative to measure the temperature of grain adjacent said capacitor, means for communicating said temperature to said control logic means, said control logic means being operative to adjust said percentage moisture content calculation to compensate for changes in temperature;

said conversion means including a frequency-to-voltage converter and an analog-to-digital converter operative to convert said frequency to a voltage level and to communicate said voltage level to said control logic means;

a control panel mounted exteriorly of said dryer and electrically connected to said control logic means, said control panel including means for communicating to said control logic means desired grain moisture content;

said control panel further including means for displaying moisture content information calculated by said control logic means; and said electrical circuit further including a communication means operative to effect communication between the sensor and external devices.

4. In combination, a continuous flow grain dryer having spaced apart exterior and interior walls, a generally continuous flow of grain between said exterior and interior walls, which flow is fed by an input means at the dryer top and flows down the length of the dryer walls to a variable discharge means, said interior walls partially defining a heat plenum, a source of hot air in communication with said plenum, said exterior and interior walls each having numerous small holes through which heated air from said heat plenum may flow, the general vertical extent of the space between said exterior and interior walls through which said hot air flows being referred to as a heat zone, said heated air flow being operative to reduce the moisture content of said grain flowing through said heat zone;

a plurality of conductors for communicating a variable voltage between two points;

support means operative to support said conductors in the heat zone of the dryer, and oriented in such a way as to allow the grain to substantially fill the space between said conductors and to flow between said conductors in response to the operation of said variable discharge means;

an electrical circuit including measuring means for determining the capacitance of said conductors, control logic means electrically connected to said measuring means and operative to calculate the percentage moisture content of the grain between said voltage communication means as a function of said capacitance, said control logic means electrically connected to said variable discharge means and operative to control the speed of said variable discharge means;

said plurality of conductors comprising at least one capacitor including at least a pair of capacitor rods, wherein said rods are substantially cylindrical and are mounted substantially parallel to each other;

said measuring means including an oscillator electrically connected to said capacitor so as to produce a variable voltage of a frequency indicative of the capacitance of said capacitor and a conversion means for communicating said frequency to said control logic means;

said electrical circuit further including a temperature sensor operative to measure the temperature of grain adjacent said capacitor, means for communicating said temperature to said control logic means, said control logic means being operative to adjust said percentage moisture content calculation to compensate for changes in temperature;

said conversion means including a frequency-to-voltage converter and an analog-to-digital converter operative to convert said frequency to a voltage level and to communicate said voltage level to said control logic means;

a control panel mounted exteriorly of said dryer and electrically connected to said control logic means, said control panel including means for communicating to said control logic means desired grain moisture content;

said control panel further including means for displaying moisture content information calculated by said control logic means; and said electrical circuit further including a communication means operative to effect communication between the sensor and external devices.

5. The invention of claim 1 wherein said communication means is an RS232 port.

6. The invention of claim 2 wherein said communications means is an RS232 port.

7. The invention of claim 3 wherein said communications means is an RS232 port.

8. The invention of claim 4 wherein said communications means is an RS232 port.

* * * * *